US006434987B1

(12) United States Patent
Juillerat et al.

(10) Patent No.: US 6,434,987 B1
(45) Date of Patent: Aug. 20, 2002

(54) MOTORIZED SECURITY LOCKING SYSTEM

(75) Inventors: Denis Juillerat; Pierre Pellaton, both of Le Locle (CH)

(73) Assignee: Ilco-Unican S.A./ Relhor Division, La Chaux-de-Fonds (CH)

( * ) Notice: Subject to any disclaimer, the term of this patent is extended or adjusted under 35 U.S.C. 154(b) by 0 days.

(21) Appl. No.: 09/613,825

(22) Filed: Jul. 11, 2000

(30) Foreign Application Priority Data

Jul. 12, 1999 (EP) ..... 99113431

(51) Int. Cl.[7] ..... E05B 15/16
(52) U.S. Cl. ..... 70/333 R; 70/278.1
(58) Field of Search ..... 292/144, 201, 292/216; 70/303 A, 303 R, 333 R, 333 A, 278.1, 416, 413

(56) References Cited

U.S. PATENT DOCUMENTS

| | | | | |
|---|---|---|---|---|
| 5,249,831 A | | 10/1993 | Maniaci | 292/144 |
| 5,473,922 A | | 12/1995 | Bair et al. | 70/416 |
| 5,592,838 A | * | 1/1997 | Clark et al. | 70/303 A |
| 5,632,169 A | * | 5/1997 | Clark et al. | 70/278 |
| 5,632,170 A | * | 5/1997 | Evans | 70/303 A |
| 5,881,589 A | * | 3/1999 | Clark et al. | 70/278 |
| 5,893,283 A | * | 4/1999 | Evans et al. | 70/303 A |
| 6,016,677 A | * | 1/2000 | Clark | 70/416 |
| 6,094,952 A | * | 8/2000 | Clark et al. | 70/278.1 |
| 6,098,433 A | * | 8/2000 | Maniaci | 70/278.1 |
| 6,196,037 B1 | * | 3/2001 | Urschel et al. | 70/416 |
| 6,212,923 B1 | * | 4/2001 | Clark | 70/416 |

FOREIGN PATENT DOCUMENTS

| | | |
|---|---|---|
| DE | 44 07 912 | 8/1995 |
| DE | 296 17 063 | 5/1997 |
| DE | 197 14 612 | 10/1998 |
| EP | 887 496 | 12/1998 |
| EP | 927 810 | 7/1999 |

* cited by examiner

*Primary Examiner*—Suzanne Dino Barrett
(74) *Attorney, Agent, or Firm*—Sughrue Mion, PLLC

(57) ABSTRACT

A motorized security locking system which is intended to be placed on the door of a high security enclosure and whose operation is reliable and more compact. The motorized security locking system includes: a case (1); a sliding bolt (3) movable in translation between an "in" position and an "out" position, and including a front end face (37), a back end face (39), two lateral faces (41), first (43) and second (45) longitudinal faces; and a controller (5) for controlling the movement of the sliding bolt, and including a motor (21), an actuator for actuating the motor, and a cam and a lever (25, 27), for connecting the motor to the sliding bolt, to transmit the drive force from the motor (21) to the sliding bolt (3) and to assure the movement thereof. The motor (21) is a motor with a single rotational direction.

18 Claims, 9 Drawing Sheets

MOTORIZED SECURITY LOCKING SYSTEM

BACKGROUND OF THE INVENTION

The present invention concerns a motorised security locking system intended to be placed on the door of a high security enclosure, such as a safe or strong room door, for example of a bank.

This motorised security locking system can assure the direct or indirect locking of the door. In the first case, it is mounted so that its lock rail slides into a door keeper provided for this purpose in the door frame. In the second case, it is installed on a strong room door as shown schematically in FIG. 1 annexed hereto.

As shown in FIG. 1, a door PO of a safe or any other security enclosure (this door being seen from the interior in FIG. 1) is generally locked, using several sliding bolts PT controlled by a boltwork assembly TR. This boltwork assembly TR includes a bar B which controls the movement of sliding bolts PT of door PO and which is coupled to a control wheel VO via a rack type mechanism.

This bar B can be moved in translation, via the action of wheel VO, to cause the movement of sliding bolts PT and to assure the door locking (sliding bolts out) and unlocking (sliding bolts in) operations.

In order to prevent door PO opening and to hold boltwork assembly TR in the locking position, this assembly includes a first lock S, itself provided with a sliding bolt PS designed to engage in bar B and block the movement in translation thereof.

However, in order to further increase the level of security and to prevent fraudulent use of this first lock S, a second motorised security type lock SSM may be associated with it guaranteeing so-called "indirect" locking of the door.

This lock SSM also includes its own sliding bolt PV, arranged to position itself on the trajectory of bar B in order to obstruct its movement to its unlocking position. In the high position of sliding bolt PV shown in FIG. 1, bar B abuts via its rear end against sliding bolt PV.

The movement of sliding bolt PV is assured by a motor M, controlled by electronic means EL. As a result of these electronic means, it is possible to programme time ranges during which sliding bolt PV prohibits bar B from sliding, even if the opening of first lock S is ordered by a valid signal, i.e. a recognised opening key or code. Security is thus doubled by preventing even authorised personnel from opening the door.

Such an electronic motorised, self-blocking security locking system for a secure door is already known from U.S. Pat. No. 5,473,922 of the prior art. This locking system includes:

- a case;
- a reversible electric motor (with dual rotational direction);
- a sliding bolt which is mobile in translation; and
- connection means for transmitting the driving force originating from the electric motor to the sliding bolt and allowing said sliding bolt to be moved from an unlocking position to a locking position and vice versa.

The movement in translation of the sliding bolt between these two end positions is assured by the rotation of the motor alternately in the clockwise and anticlockwise direction.

This device of the prior art thus has the drawback of using an electric motor with two rotational directions to drive the sliding bolt in translation in both directions. This type of motor has a more complicated structure than a motor with a single rotational direction, includes more components and the electronic control thereof is more complex. This motor is thus more frequently subject to breakdown or malfunction.

If a malfunction of motor M or electronic means EL occurs when door PO is in the locked position (sliding bolts PT out), it is then completely impossible to open the door, since sliding bolt PV of lock SSM physically blocks the movement of bar B of the boltwork assembly.

This lock SSM is designed and positioned on door PO to be inviolate, i.e. inaccessible and indestructible, which prevents any access and repairs, even by security teams.

Consequently, in order to have access to the interior of the protected enclosure, it is necessary to destroy the enclosure by making a hole in the wall thereof, or to destroy the door. In any case, it is necessary to damage the security enclosure, which is extremely expensive, both for the cost of repairing the damaged materials and devices and the cost of intervention by specialised technical teams.

Further, these operations for opening and repairing the enclosure and the door can require several hours, or even several days, to perform. During this time, access to the interior of the enclosure is prohibited, which can thus prove detrimental.

Moreover, in the security locking system disclosed in U.S. Pat. No. 5,473,922, the motor axis is parallel to the longitudinal axis of the sliding bolt which causes significant space requirement particularly in the longitudinal direction.

It would thus be desirable to be able to leave sufficient place in the case to accommodate additional detectors, without it being necessary to increase the outer dimensions of the case. In fact these dimensions are standardised, so that the locking system can be introduced into a standard recess arranged on the door, without any subsequent alterations thereto.

SUMMARY OF THE INVENTION

The object of the invention is thus to overcome the aforecited drawbacks by providing a more reliable and compact device.

This object is achieved with a motorised security locking system including:

- a case,
- a sliding bolt able to move in translation between an "in" position and an "out" position, this sliding bolt including a front end face, a back end face, two lateral faces, a first and second longitudinal faces,
- means for controlling the movement of the sliding bolt including a motor, means for actuating the motor, and means for connecting the motor to the sliding bolt, to transmit the drive force from the motor to the sliding bolt and to assure the movement thereof. According to the features of the invention this motor is a motor with a single rotational direction.

As a result of the features of the invention, the security locking system is more reliable since the motor used rotates in one direction only and is thus less liable to break down.

Preferably, the means for connecting the motor to the sliding bolt include:

- a circular cam driven in rotation by the motor, and
- a drive lever connected at one of its ends, by first fixing means, to said cam and at the other end, by second fixing means, to the sliding bolt.

According to the invention, the locking system includes means for storing the position of the sliding bolt, programmed by the sliding bolt movement control means, which, when the sliding bolt "in" position has been programmed but the sliding bolt is blocked outside the case, allow the sliding bolt to be returned to this position, or conversely, when the sliding bolt "out" position has been programmed but the sliding bolt is blocked inside the case, allows the sliding bolt to be returned to this position, as soon as the blockage ends.

More precisely, the programmed sliding bolt position storage means include a spring clip including a helical winding and two radial arms, this spring being mounted on the first longitudinal face of the sliding bolt and the means connecting the motor to the sliding bolt can wind this spring clip in the event that the sliding bolt is locked in a different position to that programmed by the sliding bolt movement control means, so that the spring clip can return the sliding bolt to the programmed position as soon as the blockage ends.

In the aforecited prior art (U.S. Pat. No. 5,473,922), when the motor acts to return the sliding bolt to the "in" position, it compresses a coil spring and the force that the motor has to exert to move the sliding bolt increases progressively with the compression of said coil spring. Consequently, the motor puts a higher demand or the power source which powers it. This power source is often an autonomous battery or cell which has difficulty tolerating abrupt variations in power demand, especially when the battery begins to run down. The locking system according to the invention avoids using this coil spring and the drawbacks linked thereto. The device according to the invention is thus more reliable.

Moreover, when a spring clip is used to return the sliding bolt into the programmed position as soon as the blockage exerted on the sliding bolt ends, the force exerted by the arms of the spring clip on the sliding bolt is constant whatever the distance between the arms.

Finally, according to an advantageous embodiment of the invention, the axis of the motor shaft is perpendicular to the longitudinal axis of the sliding bolt and parallel to the plane of the longitudinal surfaces of the sliding bolt.

This position of the motor frees space inside the case to place different sensors, such as temperature or pressure sensor or seismic sensors, for example. These sensors can be used to send data to the motor actuation means in order to close the locking system in the event of intrusion by a blow torch attack or a tool generating vibrations.

The invention will be better understood upon reading the following description of an embodiment of the invention given by way of illustrative and non limiting example, this description being made with reference to the annexed drawings in which:

DETAILED DESCRIPTION OF THE DRAWINGS

Figure 6:
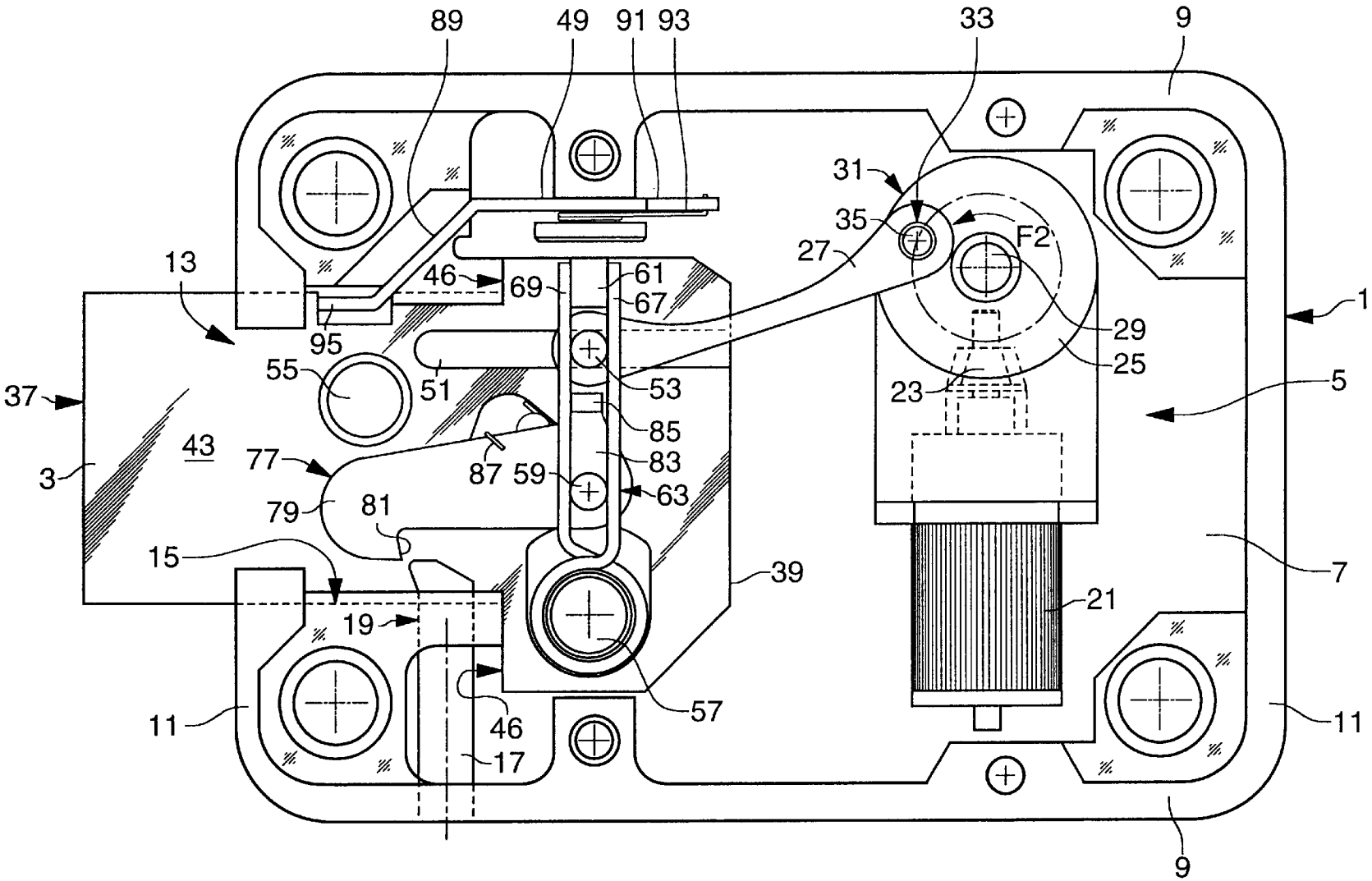
FIGS. 6 to 8 are back views of the locking system according to the invention, similar to FIG. 2, but showing the locking system in other characteristic operating positions.

An embodiment of the invention will be described hereinafter with reference first of all to FIG. 2. The security locking device according to the invention includes a parallelpiped case 1 intended to accommodate a sliding bolt 3 and means for controlling the movement of the sliding bolt, referenced generally 5. This case 1 is defined by a bottom 7, two longitudinal edges 9 and two ends edges 11. It has a median longitudinal axis X—X and is normally closed by a cover screwed onto said case, but not shown in the Figures. This case also has, in one of its end edges 11, an opening 13 for the sliding bolt to pass through. This opening 13 is delimited by the cover, the bottom of the case and by two parallel lateral guide walls 15. Sliding bolt 3 is mounted in this opening 13 with lateral operating clearances, which allow it to slide without friction, between a so-called "in" position (illustrated in FIG. 6) in which the locking system according to the invention acts to perform direct or indirect locking as defined hereinbefore.

Moreover, case 1 also includes a sliding bolt guide (not shown) provided in bottom 7 of the case to guarantee rectilinear translation of the sliding bolt.

Finally, case 1 includes a locking finger 17 formed of a substantially cylindrical element, arranged perpendicular to the median longitudinal axis X—X of the case and extending from one of longitudinal edges 9 of case, towards the interior thereof. As illustrated in FIG. 2, this locking finger projects above sliding bolt 3, through a cylindrical opening 19 opening out into one of lateral guide walls 15. The role of this locking finger 17 will be explained hereinafter.

The means for controlling the movement of sliding bolt 5 include a motor 21, means for actuating the motor (not shown) and means for connecting motor 21 to sliding bolt 3.

Motor 21 is a motor with one rotational direction powered by a cell or autonomous battery. It includes a step down gear and its motor shaft is provided with a conical gear pinion 23. As illustrated in the Figures and unlike the prior art, motor 21 is arranged in case 1 so that its longitudinal axis Y—Y (or its motor shaft axis) is perpendicular to the longitudinal axis of sliding bolt 3 and parallel to the plane of the sliding bolt's longitudinal surfaces.

The motor actuation means includes electronic means associated with peripheral display and data entry units which allow the user to open and close the locking system either immediately, or according to the predetermined time ranges or as a function of other parameters. The electronic means can also be connected to sensors giving data as to any break-in attempt on the locking system. These means are known to those skilled in the art and will not be described further.

Finally, the means for connecting the motor to the sliding bolt include a circular cam 25 and a drive lever 27.

Figure 4:
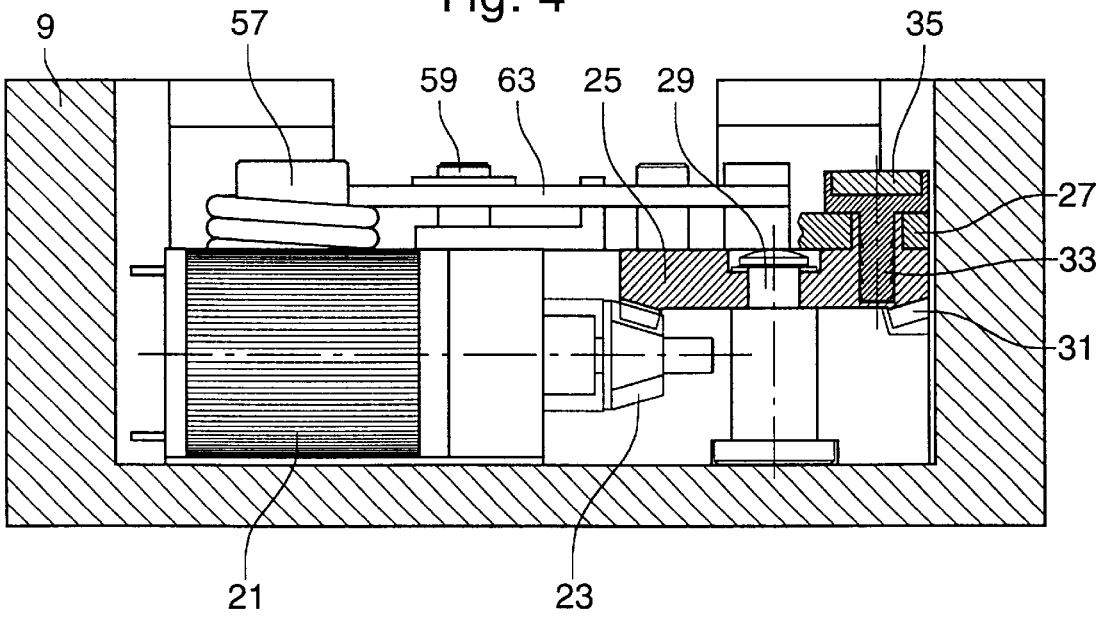
FIG. 4 is a cross-section of the locking system taken along the line VI—VI of FIG. 2.

Circular cam 25 is mounted so as to rotate freely on a shaft 29 driven into the bottom of case 1 and perpendicular to the motor shaft. Cam 25 is driven in rotation by motor 21 as a result of a second conical gear wheel 31 provided on its bottom face and meshed with the teeth of gear pinion 23 of the motor shaft. This device constitutes a bevel gear and appears more clearly in FIG. 4.

Drive lever 27 is secured via one of its ends to cam 25 by first securing means 33 and via its other end, to sliding bolt 3, by second securing means described hereinafter. It plays the role of a connecting rod and assures the movement in translation of sliding bolt 3.

More precisely, first securing means 33 are formed by a head tenon which supports and guides the end of drive lever 27 in rotation. The latter can thus pivot freely about the head tenon.

Finally, cam 25 is provided with a magnet 35, secured to said head tenon 33. This magnet 35 co-operates with a position sensor provided in the cover of the case (not shown in the Figures) and able to provide signals representing the angular position of cam 25 to the motor actuation means.

Sliding bolt 3 is formed of a block of generally substantially parallelepiped shape. It is a sliding bolt without any bevelling or lock rail. This sliding bolt has a front end face 37, a back end face 39, two narrower opposite lateral faces 41 and a first longitudinal face 43 and a second longitudinal face 45 which are also opposite and wider. Front end face 37 is defined as that located at the end of the sliding bolt which comes out of case 1. The first longitudinal face 43 is also defined as that seen in front view in FIG. 2. Face 45 is visible only in FIG. 3.

Moreover, the front portion of the sliding bolt (i.e. that which at least partially comes out of the case) is narrower than the back portion. Consequently, the two lateral faces 41 have a step 46 forming a shoulder. When the sliding bolt is in the "out" position (illustrated in FIG. 6), these two shoulders 46 abut against the inner ends of lateral guide walls 15.

A U-shaped groove 47, located in the extension of shoulder 46 and intended to co-operate with an anti-break-in device 49 the structure and operation of which will be described hereinafter, is provided on one of lateral faces 41. This anti-break-in device is secured to the longitudinal edge 9 of case 1 facing said U-shaped groove 47.

Further, second longitudinal face 45 of the sliding bolt is provided with a groove intended to co-operate with the aforementioned sliding bolt guide located on the bottom of case 1.

Moreover, the first longitudinal face 43 of the bolt is provided with a groove 51 extending along a direction parallel to the longitudinal axis of said sliding bolt and the longitudinal axis X—X of the case, over at least a portion of the length of the sliding bolt and substantially over the back half thereof. The width of this groove is such that it can accommodate a pin 53 secured to the end of drive lever 27 and able to slide into said groove between two end positions illustrated respectively in FIGS. 9 and 10.

Figure 3:
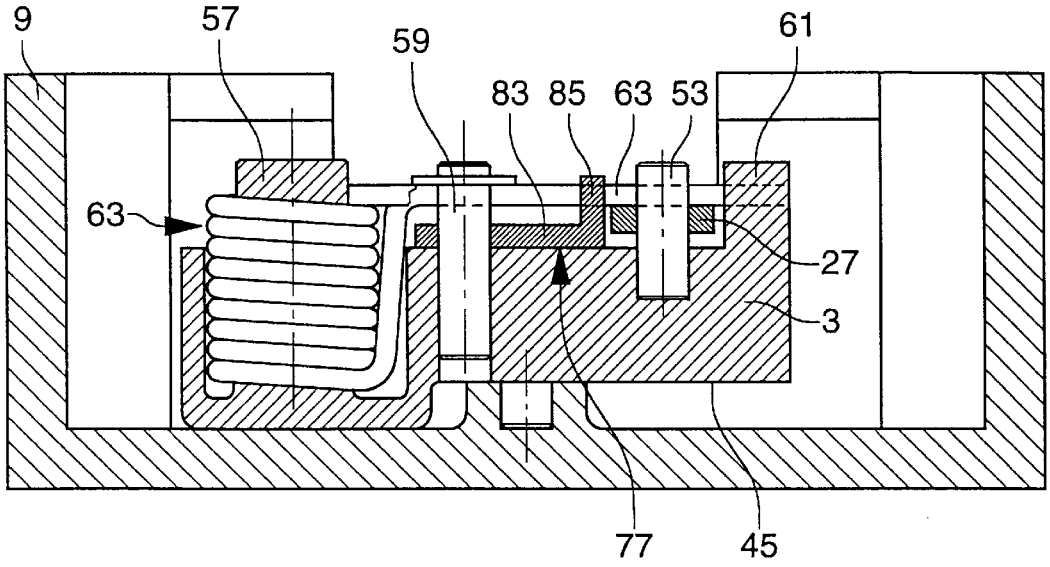
FIG. 3 is a cross-section of the locking system taken along the line III—III of FIG. 2.

Finally, first longitudinal face 43 of the sliding bolt preferably has on its front portion, a magnet 55 and on its enlarged back portion, a pin 57, a pin 59 and an limit stop 61, these three latter elements being aligned along a line Z—Z perpendicular to the axis of groove 51. This line Z—Z appears in FIG. 7. Limit stop 61 and pin 57 are integral with sliding bolt 3, as illustrated in FIG. 3. Magnet 55 co-operates with a position sensor which is provided in the case cover and which is not shown in the Figures. This position sensor can provide the motor actuation means with signals representing the position of sliding bolt 3 in case 1.

Pin 57 and limit stop 61 allow a spring clip 63 to be positioned.

Figure 5:
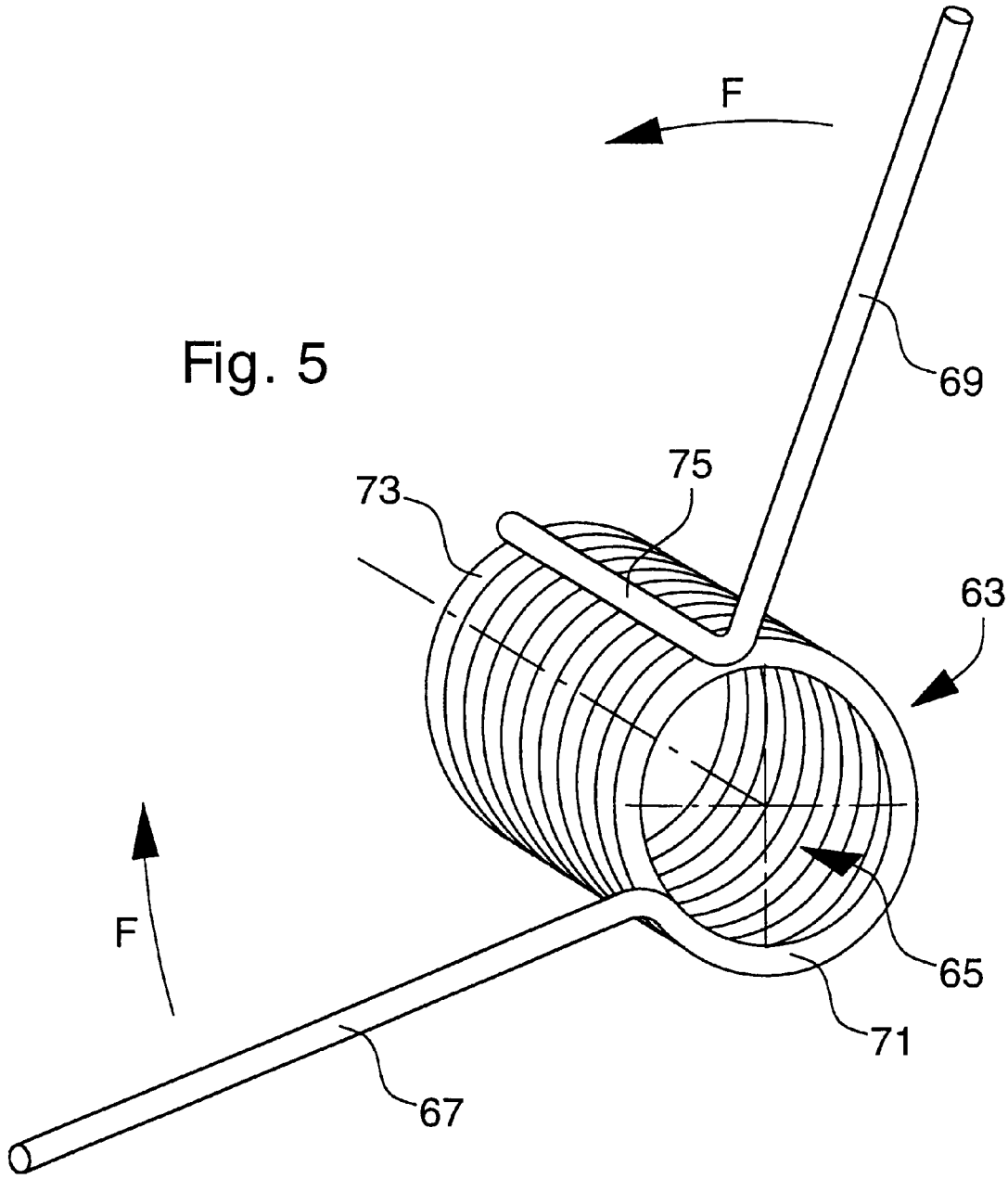
FIG. 5 is a perspective view of the spring clip intended to be mounted in the locking system according to the invention.

This spring clip 63 is illustrated in the non-loaded position in FIG. 5. It has a body formed of a helical winding 65 with several turns and two radial arms, formed of a single resilient metal wire. According to the arrangement of the spring in FIG. 5, these two arms are designated respectively the left arm 67 and the right arm 69. Left arm 67 is connected to first turn 71 of the spring and right arm 69 to the last turn 73 of the winding by a return wire 75 extending along said body 65. When this spring clip 63 is positioned on sliding bolt 3, helical winding 65 freely surrounds pin 57 and last turn 73 is located against first longitudinal face 43 of the sliding bolt.

When the spring is in the free state (not loaded), illustrated in FIG. 5, the two arms 67 and 69 tend to move away from each other. Conversely, when spring clip 63 is mounted on the sliding bolt, these two arms are stretched in the direction of arrows F of FIG. 5 to cross over each other as illustrated in FIG. 2. These two arms 67 and 69 are held under tension in this position by limit stop 61 which imprisons them. Under the action of the constraint force absorbed by the spring clip, the two arms 67 and 69 tend to move away from each other (to return to the position illustrated in FIG. 5) and consequently press strongly on either side of limit stop 61.

Spring clip 63 is positioned on sliding bolt 3 so that the two radial arms extend parallel to the plane of first longitudinal face 43 of the sliding bolt, perpendicular to groove 51 and above the latter. Further, pin 53 of the drive lever is positioned simultaneously in groove 51 and between the two radial arms 67 and 69 of the spring clip. In other words, the two arms 67 and 69 and groove 51 define a housing for accommodating pin 53.

Figure 2:
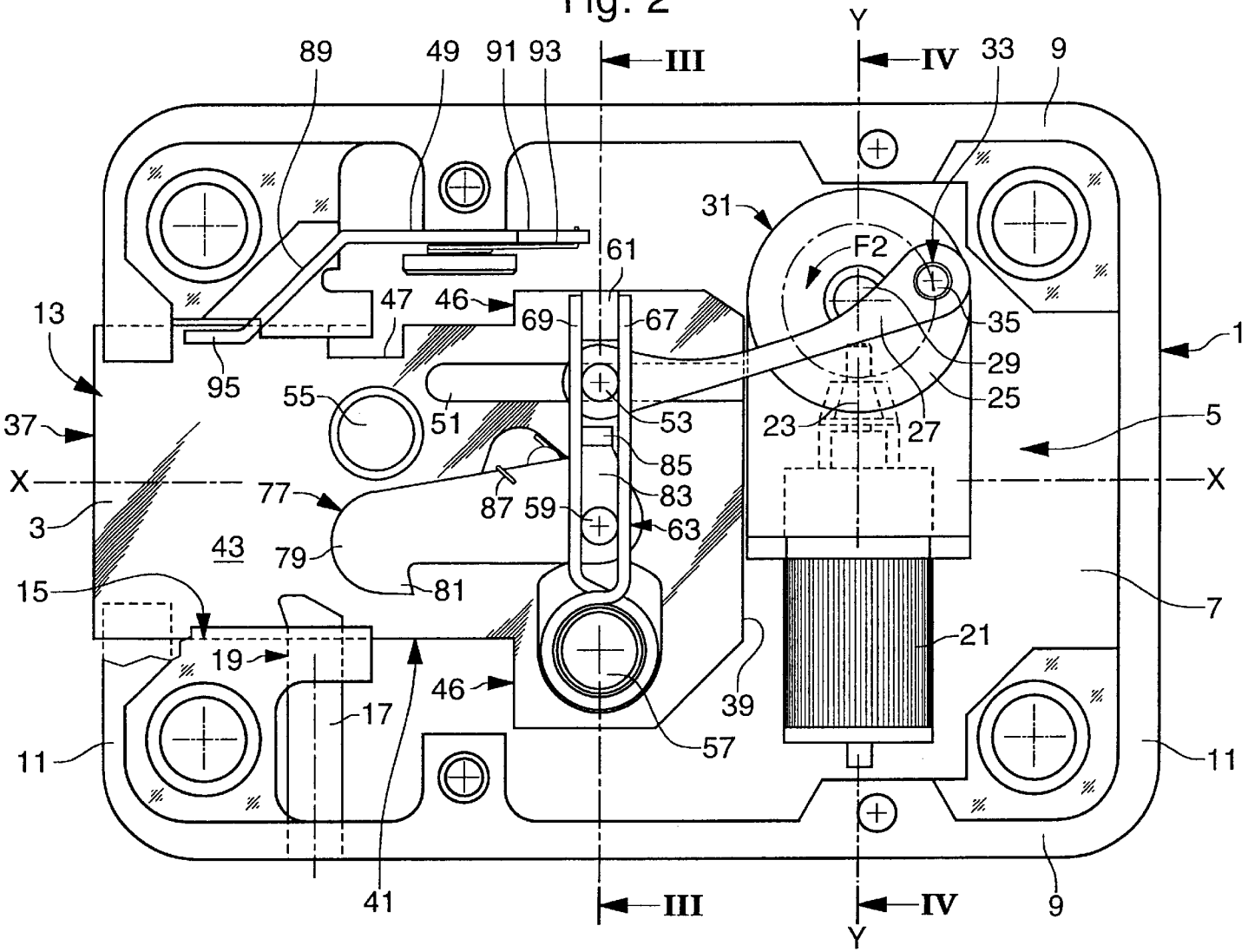
FIG. 2 is a back view of the case of the locking system according to the invention in a first characteristic operating position, the cover which normally covers the case having been removed for the sake of simplification.

The wire forming spring clip 63 can absorb the bending stress, which allows the two arms 67 and 69 to move away from each other under certain extreme stress (see FIGS. 9 and 10) by stretching the spring even further, then returning to their configuration illustrated in FIG. 2.

As illustrated in FIG. 2, and in an optional manner, sliding bolt 3 is also provided with a lever 77 for locking the sliding bolt in the "out" position. This L-shaped lever has two arms. One of the arms 79 is provided at its free end with a hook 81 intended to co-operate with said locking finger 17 described hereinbefore. The other arm 83 is provided at its free end with an actuation snug 85 integral therewith, perpendicular to the plane of said lever 77. This lever can pivot about pin 59 and it is wound by a spring 87. As illustrated in FIG. 3, spring 87 is placed between first longitudinal face 43 of the sliding bolt and lever 77.

Locking lever 77 is arranged on sliding bolt 3 and under spring clip 63 so that snug 85 projects between the two arms 67 and 69 of the spring clip. Spring 87 tends to swing lever 77 in the direction of arrow Fl (FIG. 7), so that hook 81 is blocked on locking finger 17 and opposes the withdrawal movement of the sliding bolt.

Finally, the locking system according to the invention includes an anti-break-in device 49 formed of a Z-shaped strip 89 one of whose ends 91 is wound by a spring 93. This device occupies the position illustrated in FIG. 2 when the cover (not shown) is screwed onto case 1, as a result of a lug provided in the case which blocks strip 89. In the event of a break-in, if a criminal removes the cover, the latter no longer holds end 91 of strip 89 and the latter pivots until its other end 95 engages in U-shaped groove 47 thereby blocking sliding bolt 3 in the "out" position. This device is conventional and will not be described further.

The operation of the security locking system and the movement of its different constituent components will now be described with reference in particular to FIGS. 2 and 6 to 8.

In the starting position illustrated in FIG. 2, sliding bolt 3 is in the "in" position. The user of the locking system inputs data via a keyboard of the motor actuation means, which has the effect of causing motor 21 to rotate and via bevel gear 23, 31, cam 5 to rotate in the anticlockwise direction (arrow F2). This rotation of cam 5 causes head tenon 33 and thus drive lever 27 to move to the position illustrated in FIG. 6. Pin 53 located at the end of drive lever 27 is secured to sliding bolt 3 since it is held on the one hand by groove 51, and on the other hand by the two arms of spring clip 63 which is itself secured to sliding bolt 3. The movement of the arm of lever 27 thus causes the sliding bolt to move to the "out" position illustrated in FIG. 6 until the two shoulders 46 of the sliding bolt abut against the inner ends of lateral guide walls 15 of the sliding bolt. In this position, sliding bolt 3 cannot come further out of case 1.

Figure 7:
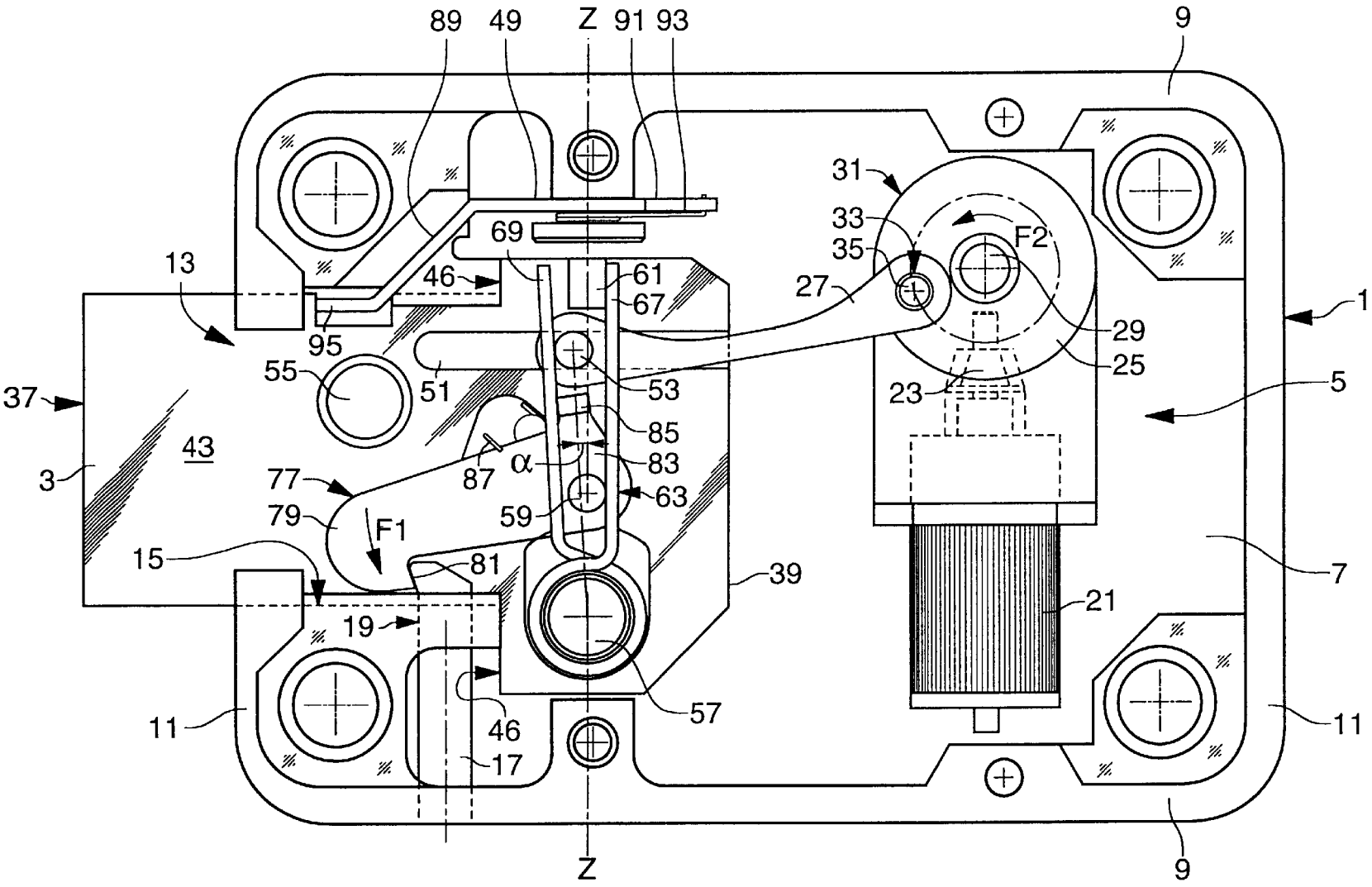

When cam 25 continues its rotation to the position of FIG. 7, drive lever 27 reaches its maximum position to the left of FIG. 7 and pin 53 is then slightly off-centre with respect to the line Z—Z connecting the centre of limit stop 61 to the centre of pin 57. In other words, the straight line connecting centre of pin 53 and pin 57 forms a small angle a with line Z—Z. In this end position, pin 53 presses on arm 69 so as to move this arm away slightly. Since snug 85 of locking lever 77 is no longer being held, spring 87 returns locking lever 77 by causing it to pivot in the anticlockwise direction (arrow Fl). Hook 81 then catches on locking finger 17. Sliding bolt 3 is then locked in the "out" position.

Figure 8:
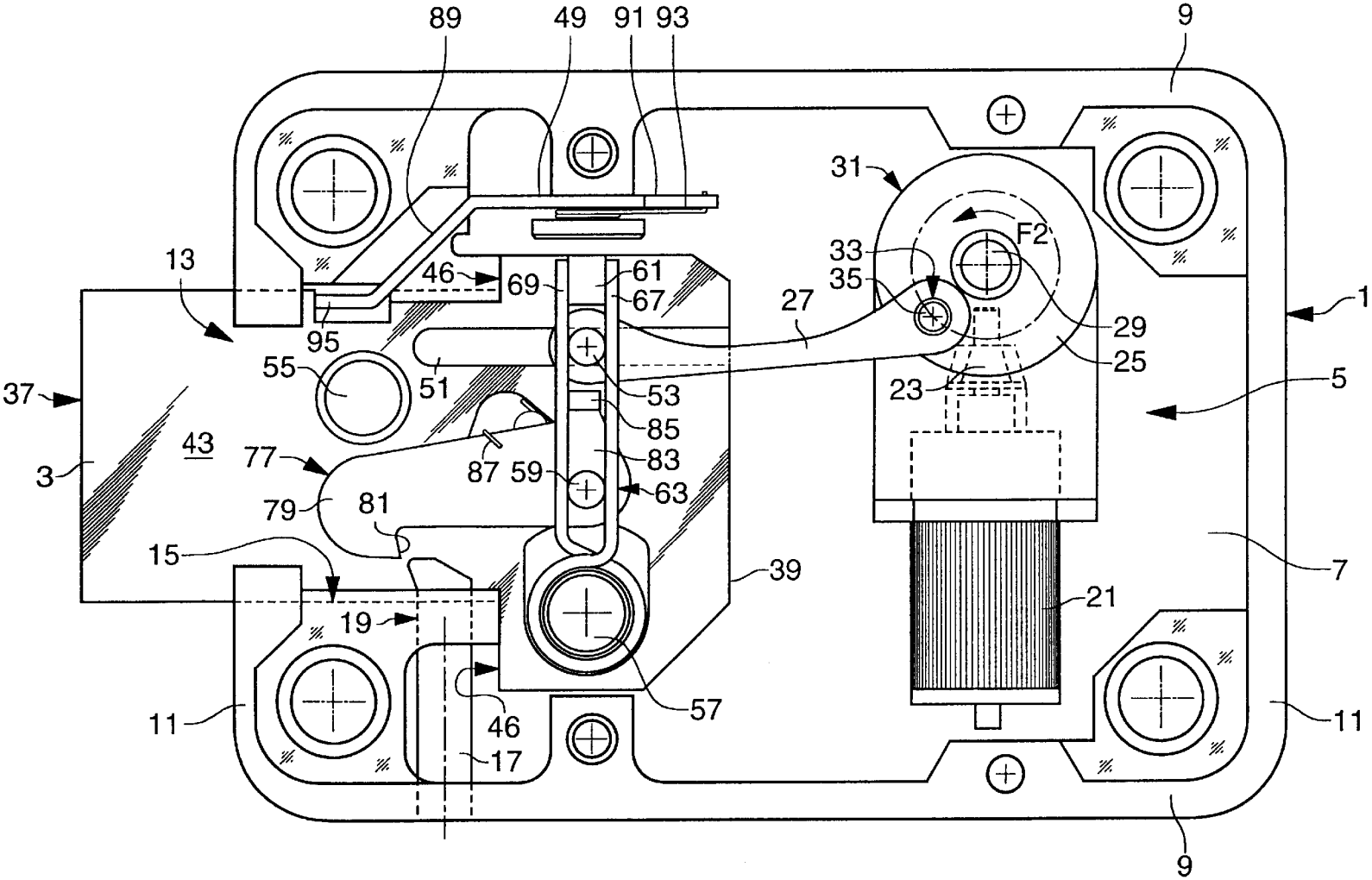

When the user wishes to unlock the locking system, he actuates motor 21 so that cam 25 continues its rotation in direction F2, to occupy the position illustrated in FIG. 8. In this position, drive lever 27 is brought very slightly towards the right until pin 53 is again aligned with limit stop 61 and pin 57. Arm 69 then exerts pressure on snug 85 against the force of spring 87 and returns locking lever 77 to an unlocked position. The remainder of the rotation of cam 25 returns all the elements to the initial position of FIG. 2 in which the locking system is open.

Thus it will be noted that, unlike the prior art, the rotation of motor 21 in a single direction allows the locking system to be both locked and unlocked.

Figure 1:
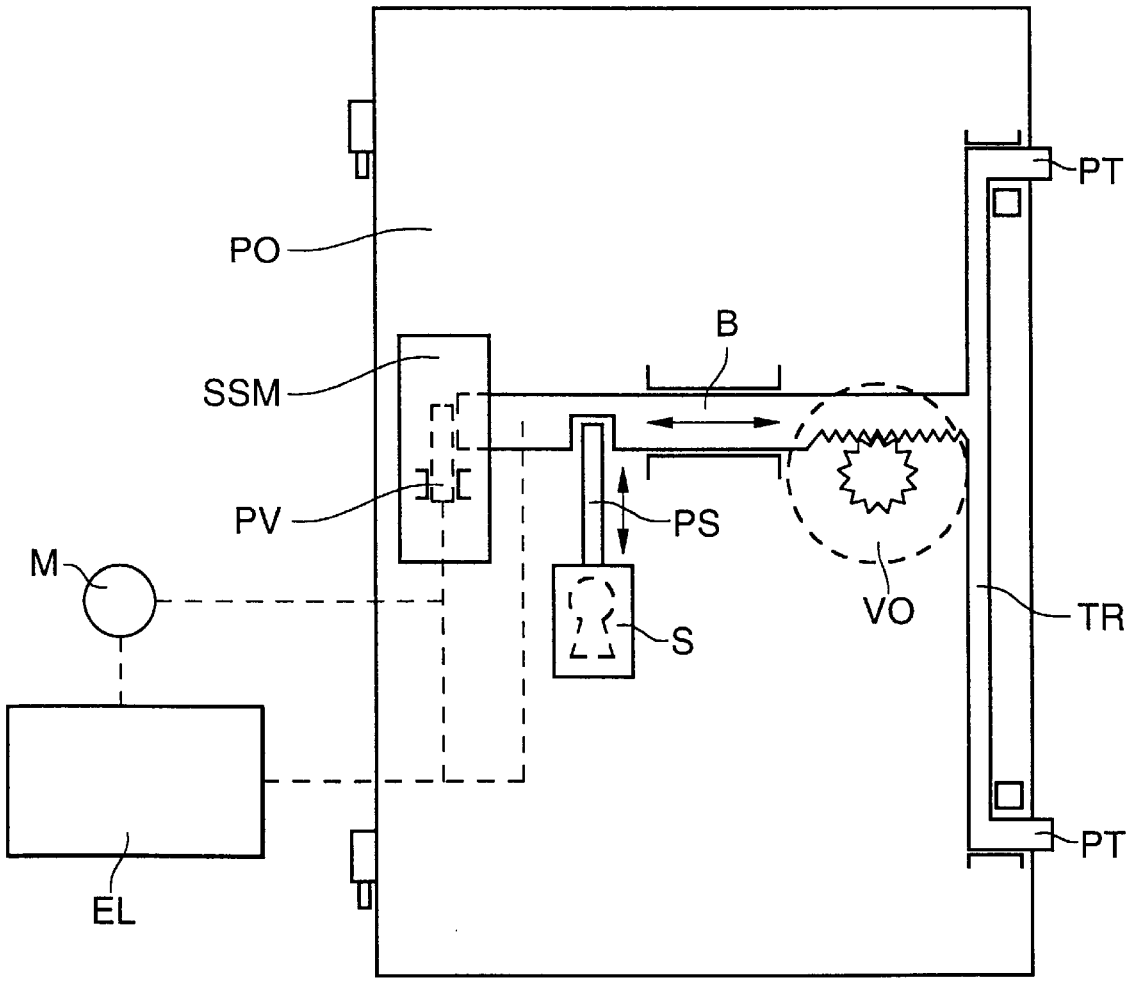
Fig. 1 PRIOR ART
FIG. 1 is a schematic overall view of a security enclosure door, provided with the motorised security locking system according to the invention.
Figure 9:
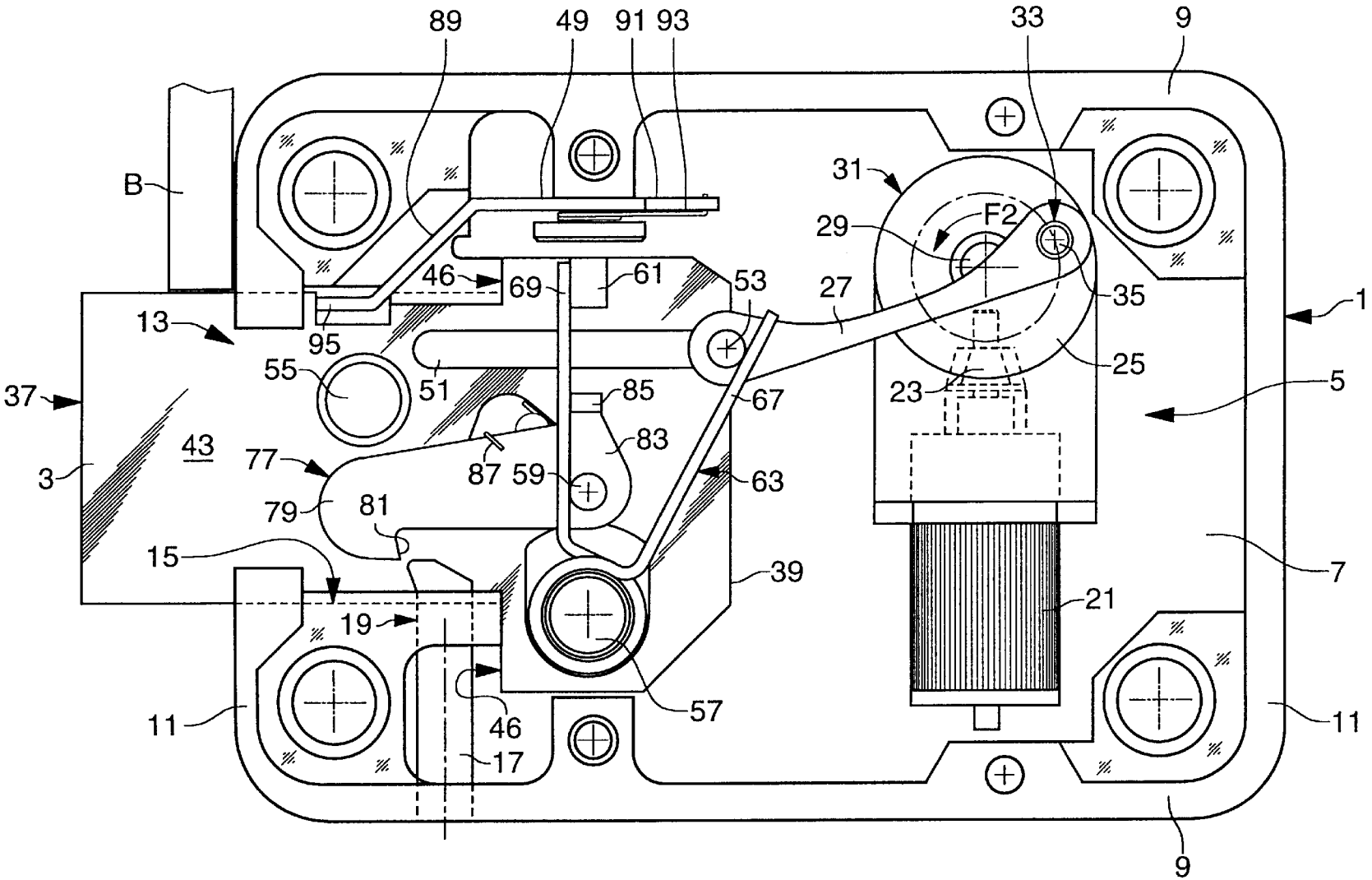
FIGS. 9 and 10 are similar back views to FIG. 2, showing the locking system according to the invention in positions in which the sliding bolt is blocked respectively in the "out" position and the "in" position.

FIG. 9 illustrates a particular case in which the "in" position of the sliding bolt is desired by the user and thus programmed via sliding bolt movement control means 5, but in which sliding bolt 3 remains blocked in the "out" position by bar B of the boltwork assembly illustrated in FIG. 1.

In this case, sliding bolt movement control means 5 have caused cam 25 to rotate and drive lever 27 to move to the position illustrated in FIG. 2. However, since sliding bolt 3 is blocked in the "out" position, pin 53 of drive lever 27 slides to the back end of groove 51 and consequently spring clip 63 opens, its two arms resiliently moving apart. It may thus be considered that the movement of sliding bolt 3 to its "in" position is stored by the spring clip. When sliding bolt 3 is no longer blocked because bar B is moved, sliding bolt 3 finishes its travel to the "in" position (FIG. 2) as a result of the return force exerted by spring clip 63.

Figure 10:
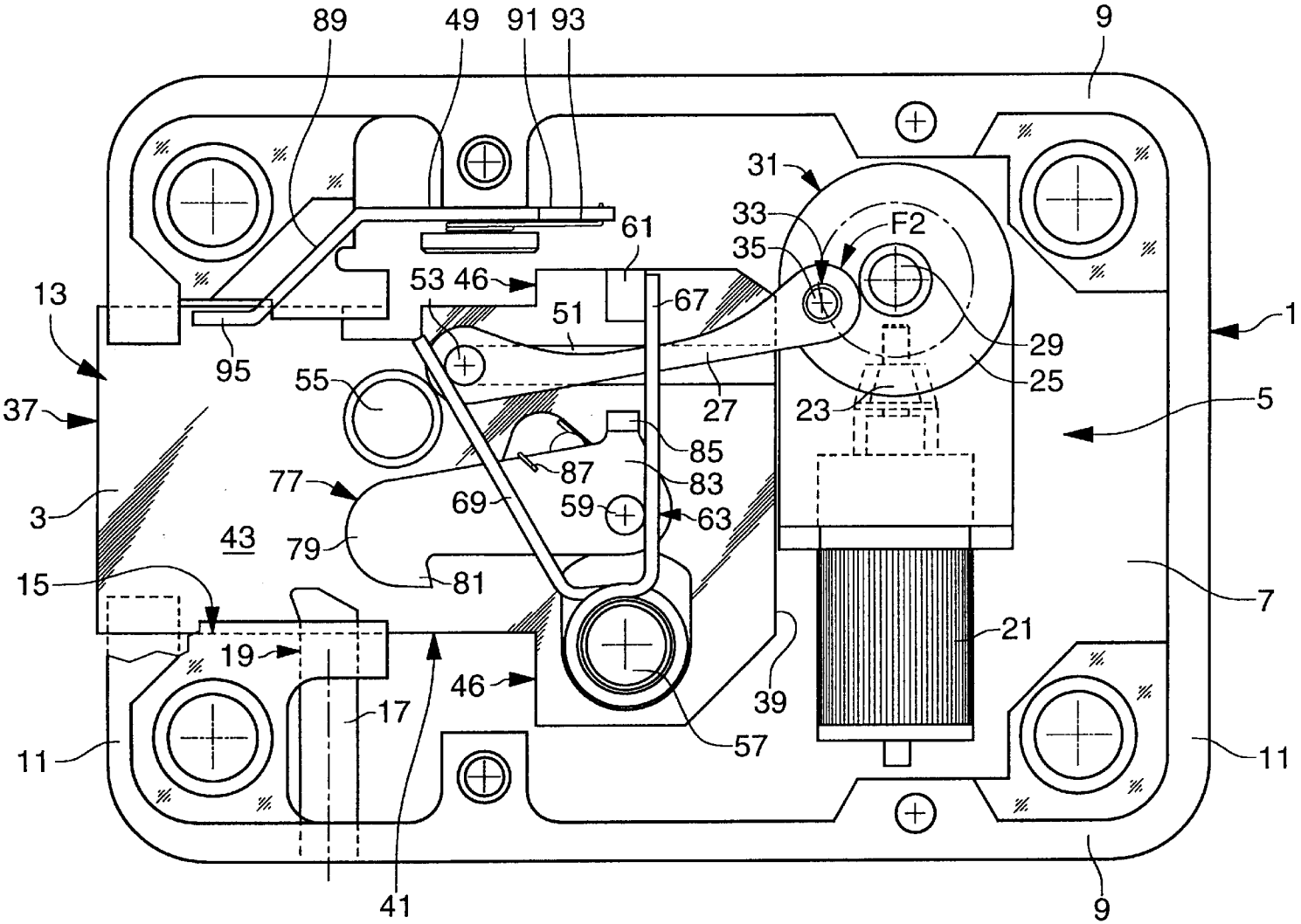

FIG. 10 illustrates the particular opposite case in which the "out" position of sliding bolt 3 is programmed but in which the sliding bolt is held in the "in" position by an external action. Similarly, the movement of cam 25 and drive lever 27 causes the arms of spring clip 63 to move apart and when sliding bolt 3 is no longer blocked, spring clip 63 exerts a return force which returns the sliding bolt to the "out" position.

What is claimed is:

1. A motorised security locking system including:

a case, a sliding bolt able to move in translation between an "in" position and an out position, said sliding bolt including a front end face, a back end face, two lateral faces, and first and second longitudinal faces, means for controlling the movement of the sliding bolt including a motor with a single rotational direction, means for actuating said motor, and means for connecting the motor to the sliding bolt, to transmit a drive force from the motor to said sliding bolt and to assure the movement thereof, and means, for storing a position of the sliding bolt as programmed by the sliding bolt movement control means, which is when the sliding bolt "in" position has been programmed but the sliding bolt is blocked outside the case, allow the sliding bolt to be returned to this position, as soon as the blockage ends, or (2) conversely, when the sliding bolt "out" position has been programmed but the sliding bolt is blocked inside the case, allow the sliding bolt to be returned to said "out" position as soon as the blockage ends, wherein said storing means are mounted and positioned on one of said longitudinal faces for co-operating with said means for connecting the motor to the sliding bolt, said storing means being able to move in translation with the sliding bolt between "in" position and "out" position.

2. A motorised security locking system according to claim 1, wherein the means for connecting the motor to the sliding bolt include:

a circular cam driven in rotation by the motor, and a drive lever connected at one end thereof, by first fixing means, to said cam and atanother end thereof, by second fixing means, to the sliding bolt.

3. A motorised security locking system according to claim 2, wherein the sliding bolt programmed position storage means include a spring clip including a helical winding and two radial arms, said spring clip being mounted on the first longitudinal face of the sliding bolt, and wherein the means for connecting the motor to the sliding bolt can wind said spring clip in the event that the sliding bolt is blocked in a position different from that programmed by the sliding bolt movement control means, so that the spring clip can return the sliding bolt to the programmed position as soon as the blockage ends.

4. A motorised security locking system according to claim 3, wherein the sliding bolt has, on the first longitudinal face, a groove extending, along a direction parallel to an axis of translation of said sliding bolt, over at least a portion of the length of said sliding bolt, wherein the second means for fixing the drive lever to the sliding bolt are formed by a pin able to slide into said groove of the sliding bolt, and wherein the spring clip is positioned on the sliding bolt so that said two radial arms extend, parallel to the plane of the first longitudinal face of the sliding bolt, and perpendicular to said groove and above said groove, so that the pin of the drive lever is positioned simultaneously in the groove and between the two radial arms so as to be able to act thereon.

5. A motorised security locking system according to claim 1, wherein the axis of the motor shaft is perpendicular to the longitudinal axis of the sliding bolt and parallel to the plane of the longitudinal surfaces of the sliding bolt.

6. A motorised security locking system according to claim 1, wherein the motor actuation means include electronic means associated with peripheral display and data entry units.

7. A motorised security locking system according to claim 2, wherein the axis of the motor shaft is perpendicular to the longitudinal axis of the sliding bolt and parallel to the plane of the longitudinal surfaces of the sliding bolt; and wherein the connection between the motor shaft and the cam is achieved by a bevel gear, formed by a first conical gear wheel arranged at the free end of the motor shaft and a second conical gear wheel provided on the opposite face of the cam to that on which the end of the transmission lever is fixed.

8. A motorised security locking system according to claim 1, including means for locking the sliding bolt in the "out" position.

9. A motorised security locking system according to claim 8, wherein the locking means include a locking lever mounted so as to pivot on the sliding bolt and able to co-operate with a locking finger secured to the case when the sliding bolt is in the "out" position.

10. A motorised security locking system according to claim 3, wherein the locking means include a locking lever mounted so as to pivot on the sliding bolt and able to co-operate with a locking finger secured to the case when the sliding bolt is in the "out" position, wherein the locking lever is an L-shaped lever wound by a spring, having two arms located on either side of a pivoting pin, the first arm having a hook intended to co-operate with the locking finger and the second arm including an actuation snug, and wherein said locking lever is arranged on the first longitudinal face of the sliding bolt so that said actuation snug is located between the two arms of the spring clip so that the latter can act on said actuation snug in order to control the movement of said locking lever.

11. A motorised security locking system according to claim 1, including an anti-break-in device designed to block the sliding bolt in the "out" position, if the cover of the case is removed.

12. A motorised security locking system according to claim 4, wherein the two radial arms of said spring clip are held under tension by a limit stop on the first longitudinal face, the force exerted by said arms of the spring clip on the sliding bolt being constant whatever the distance between the arms.

13. A motorised security locking system including:

a case, a sliding bolt able to move in translation between an "in" position and an "out" position, this sliding bolt including a front end face, a back end face, two lateral faces, a first and second longitudinal faces, means for controlling the movement of the sliding bolt including a motor with a single rotational direction, means for actuating said motor, and means for connecting the motor to the sliding bolt, to transmit the drive force from the motor to said sliding bolt and to assure the movement thereof, and means for storing the position of the sliding bolt, programmed by the sliding bolt movement control means, which, when the sliding bolt "in" position has been programmed but the sliding bolt is blocked outside the case, allow the sliding bolt to be returned to this position, as soon as the blockage ends, or conversely, when the sliding bolt "out" position has been programmed but the sliding bolt is blocked inside the case, allow the sliding bolt to be returned to this position, as soon as the blockage ends, wherein said storing means include a spring clip, which includes a helical winding and two radial arms, said spring clip being mounted on the first longitudinal face of the sliding bolt and said two radial arms being positioned parallel to the plane of said first longitudinal face, and wherein the means for connecting the motor to the sliding bolt can wind said spring clip in the event that the sliding bolt is blocked in a different position to that programmed by the sliding bolt movement control means, so that the spring clip can return the sliding bolt to the programmed position as soon as the blockage ends.

14. A motorised security locking system according to claim 13, wherein the means for connecting the motor to the sliding bolt include:

a circular cam driven in rotation by the motor, and a drive lever connected at one end, by first fixing means, to said cam and at another end, by second fixing means, to the sliding bolt.

15. A motorised security locking system according to claim 14, wherein the two radial arms of said spring clip are held under tension by a limit stop on the first longitudinal face, and wherein a pin of the second fixing means of said drive lever is positioned between said two radial arms under tension, and able to slide into a groove extending along a direction parallel to the axis of translation of said sliding bolt, over at least a portion of the length of said sliding bolt.

16. A motorised security locking system including:

a case, a sliding bolt able to move in translation between an "in" position and an "out" position, this sliding bolt including a front end face, a back end face, two lateral faces, a first and second longitudinal faces, said sliding bolt having on the first longitudinal face, a groove extending along a direction parallel to the axis of translation of said sliding bolt, over at least a portion of the length of said sliding bolt, means for controlling the movement of the sliding bolt including a motor with a single rotational direction, means for actuating said motor, and means for connecting the motor to the sliding bolt, to transmit the drive force from the motor to said sliding bolt and to assure the movement thereof, said connecting means including a circular cam driven in rotation by the motor and a drive lever connected at one end, by first fixing means, to said cam and at another end, by second fixing means, to the sliding bolt and means for storing the position of the sliding bolt, programmed by the sliding bolt movement control means, which, when the sliding bolt "in" position has been programmed but the sliding bolt is blocked outside the case, allow the sliding bolt to be returned to this position, as soon as the blockage ends, or conversely, when the sliding bolt "out" position has been programmed but the sliding bolt is blocked inside the case, allow the sliding bolt to be returned to this position, as soon as the blockage ends, wherein said storing means include a spring clip, which includes a helical winding and two radial arms, said spring clip being mounted on the first longitudinal face of the sliding bolt, and said two radial arms being parallel to the plane of said first longitudinal face and perpendicular to said groove of the sliding bolt and above the latter, and wherein the second fixing means, for securing the drive lever to the sliding bolt, are formed by a pin able to slide into said groove of the sliding bolt and positioned simultaneously in the groove and between the two radial arms so as to be able to act thereon.

17. A motorised security locking system according to claim 16, wherein the two radial arms of said spring clip are held under tension by a limit stop on the first longitudinal face, the force exerted by said arms of the spring clip on the sliding bolt being constant whatever the distance between the arms.

18. A motorised security locking system according to claim 16, wherein said first longitudinal face of the sliding bolt includes a magnet intended to co-operate with a position sensor provided in the case in order to provide the motor actuation means with signals representing the position of sliding bolt.

* * * * *